US008376795B2

(12) United States Patent
Tawa et al.

(10) Patent No.: US 8,376,795 B2
(45) Date of Patent: Feb. 19, 2013

(54) ENGINE FOR OUTBOARD MOTOR

(75) Inventors: Hiroki Tawa, Saitama (JP); Kazuyoshi Sato, Saitama (JP); Kentaro Furuya, Saitama (JP); Hiroshi Yamamoto, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 267 days.

(21) Appl. No.: 12/716,811

(22) Filed: Mar. 3, 2010

(65) Prior Publication Data

US 2010/0267298 A1 Oct. 21, 2010

(30) Foreign Application Priority Data

Apr. 15, 2009 (JP) ..... P2009-099140

(51) Int. Cl.
*B63H 20/00* (2006.01)

(52) U.S. Cl. ..... 440/88 L

(58) Field of Classification Search ..... 440/88 L
See application file for complete search history.

(56) References Cited

U.S. PATENT DOCUMENTS 4,101,000 A * 7/1978 Scully ..... 184/1.5
6,129,058 A * 10/2000 Muth ..... 123/41.86
6,960,296 B2 * 11/2005 Morita ..... 210/234
7,086,915 B2 * 8/2006 Hikosaka et al. ..... 440/88 L

FOREIGN PATENT DOCUMENTS

JP 08-068335 3/1996
JP 2000-110537 4/2000
JP 2005-343226 A 12/2005

OTHER PUBLICATIONS

Notification of Reasons for Refusal mailed Oct. 2, 2012, (Patent Application No. P2008-080263) with Partial English Translation.

* cited by examiner

*Primary Examiner* — Stephen Avila
(74) *Attorney, Agent, or Firm* — Arent Fox LLP

(57) ABSTRACT

An engine for an outboard motor includes an oil filter. A first oil passage has a communication duct disposed at a position lower than that of the oil filter and communicating with a crank chamber. The communication duct is closed by a drain valve that can be opened and closed manually. Opening the drain valve allows the oil accumulated in the first oil passage to flow down into the crank chamber through the communication duct.

1 Claim, 8 Drawing Sheets

FIG.4
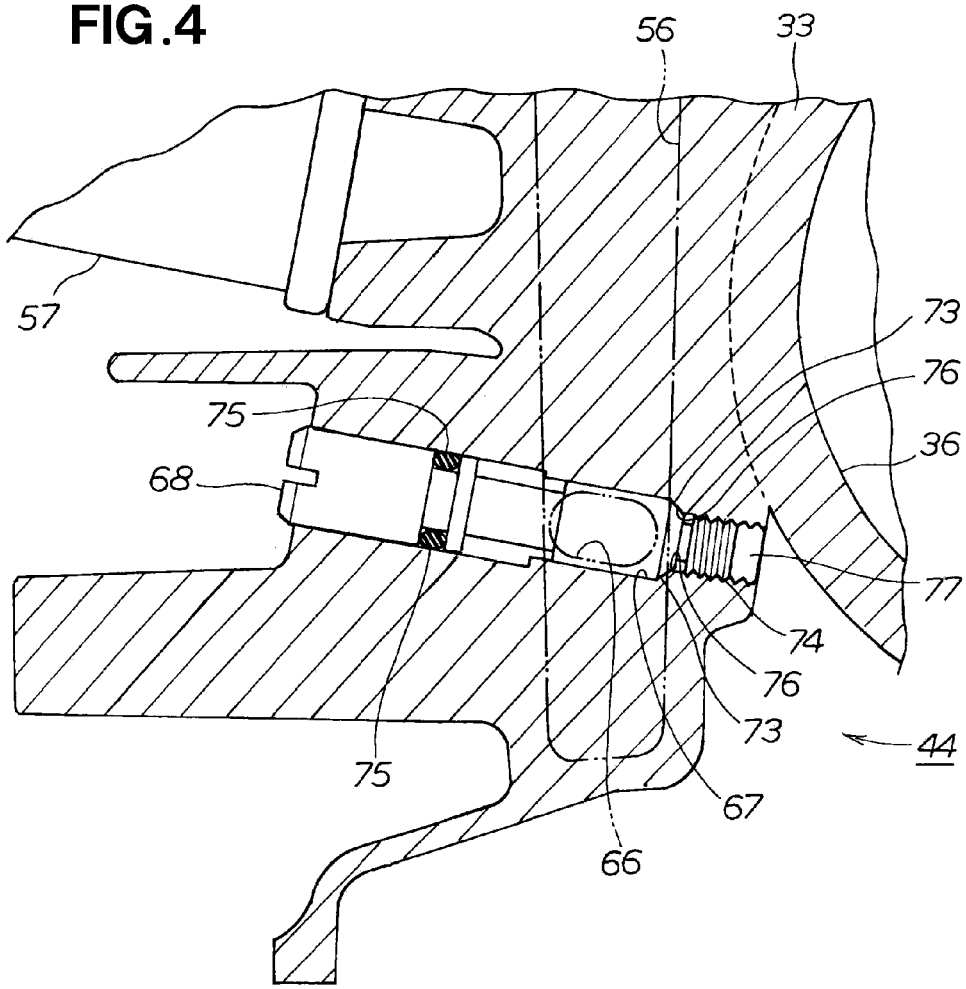
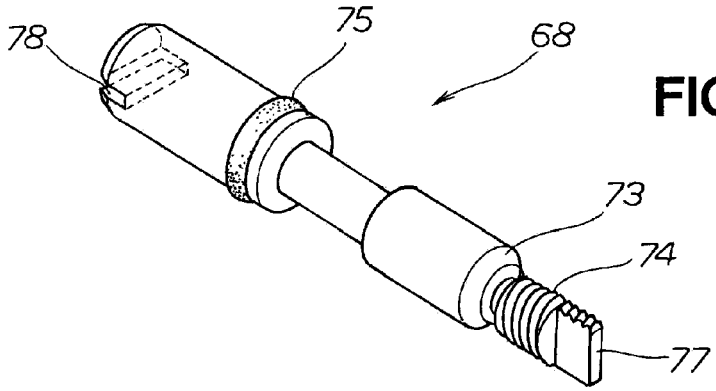
FIG.5

ENGINE FOR OUTBOARD MOTOR

FIELD OF THE INVENTION

The present invention relates to an engine for an outboard motor having an oil filter.

BACKGROUND OF THE INVENTION

There have been conventionally known outboard motors which include oil filters for filtering engine oil, such as the one disclosed in Japanese Patent Application Laid-Open Publication No. 2005-343226 (JP 2005-343226 A). FIGS. 7 and 8 hereof show the outboard motor disclosed in JP 2005-343226 A.

Referring to FIG. 7, an outboard motor 100 as an example of the prior art is designed so that the oil collected in an oil pan 102 of a longitudinal engine 101 in which the crankshaft is longitudinally oriented is suctioned up by an oil pump and filtered by an oil filter 103. The filtered oil is supplied to top and bottom bearings of the crankshaft via a main gallery which is an oil passage disposed vertically within a cylinder block 104, and is also supplied to a camshaft of the engine 101, whereby these components can be appropriately lubricated.

The oil filter 103 is replaced either periodically or after a specified amount of use. FIG. 8 is used to describe the oil filter replacement procedure normally performed with an outboard motor.

According to FIG. 8, the oil filter 103 is removed and a new oil filter 103 is installed. The oil filter 103 is installed in a removable manner in the cylinder block 104 so as to be positioned in the vertical center of the main gallery 105. When the oil filter 103 is removed, the oil above the oil filter 103 from the oil that has accumulated in the main gallery 105 flows out to the exterior through a filter attachment hole 106 as shown by arrow (1). An operator must wipe up the leaked oil, and the operation is troublesome. Therefore, there is a demand for an engine for an outboard motor in which the oil filter can be replaced without the oil flowing out to the exterior.

SUMMARY OF THE INVENTION

It is therefore an object of the present invention to provide an engine for an outboard motor in which the oil filter can be replaced without the oil flowing out to the exterior.

According to the present invention, there is provided an engine for an outboard motor, which engine comprises: an oil pan disposed underneath a crank chamber; an oil pump for pumping up oil in the oil pan; an oil filter for filtering the oil that has been pumped up; and a vertically extending oil passage for leading the filtered oil to parts required by the engine, wherein the oil passage has a communication duct disposed lower than the oil filter and communicating with the crank chamber, the communication duct being closed by a drain valve capable of manual opening and closing.

In this arrangement, opening the drain valve allows the oil accumulated in the oil passage to flow out into the crank chamber. Since the oil that has accumulated inside the oil passage is no longer higher than the oil filter, the oil will not flow out to the exterior when the oil filter is removed. As a result, the operation of replacing the oil filter is improved. Additionally, since the amount of oil in the engine is not reduced and there is no need to refill oil, it is possible to reduce the number of steps in the operation.

Preferably, the oil passage has an air inlet duct positioned higher than the oil filter and designed to let air in from an exterior, the air inlet duct being closed by an air vent bolt capable of manual opening and closing. As a result, air is led into the oil passage when the air vent bolt is opened. When air is led into the oil passage, the flow rate of oil significantly increases. As a result, the oil filter can be removed immediately, and the overall operation time can be reduced.

Desirably, the drain valve has a tapered part at a distal end thereof for closing off the communication duct. As a result, it becomes possible to reduce machining expenses because it is easy to machine a taper in the cylinder block-facing side of the drain valve where the tapered part is formed.

In a preferred form, the drain valve has a small-sectional-area part located farther distally outward than the tapered part and having less sectional surface area than a flow passage surface area of the communication duct, the small-sectional-area part being inserted through the communication duct. Thus, oil can flow out into the crank chamber when the small-sectional-area part has been inserted through the communication duct, the drain valve is easily closed back up, and the number of steps in the operation can therefore be reduced.

BRIEF DESCRIPTION OF THE DRAWINGS

A preferred embodiment of the present invention will be described in detail below, by way of example only, with reference to the accompanying drawings, in which:

FIG. 4 is a cross-sectional view taken along line 4-4 of FIG. 2;

FIG. 5 is a perspective view showing a drain valve of FIG. 4;

DETAILED DESCRIPTION OF THE PREFERRED EMBODIMENT

Figure 1:
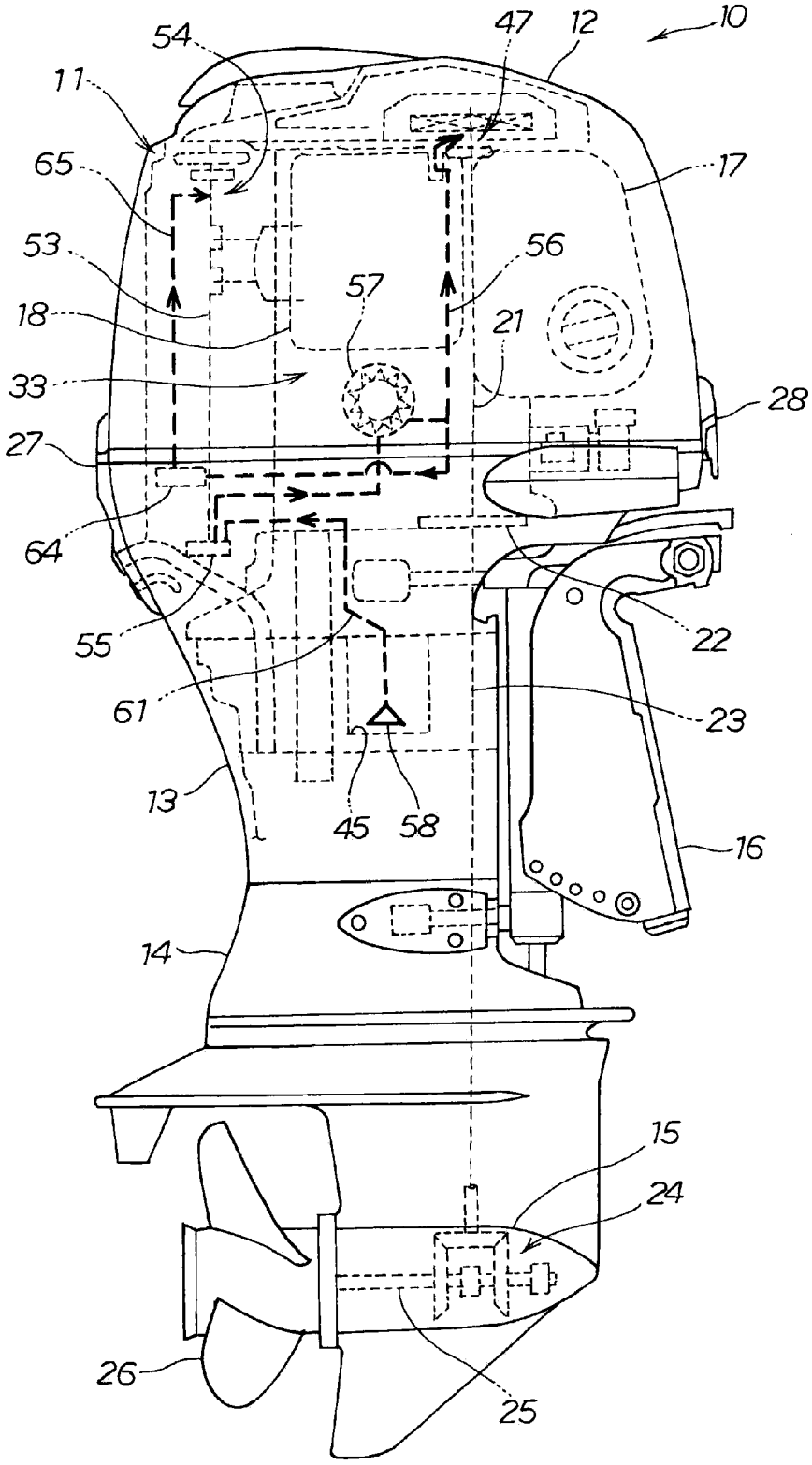
FIG. 1 is a side elevational view showing an outboard motor having an oil filter and a manner of flow of oil therein.

Referring to FIG. 1, an outboard motor 10 has an engine 11 at the top. The engine 11 is a longitudinal engine in which the cylinders and pistons are oriented transversely, and the crankshaft and camshaft are oriented longitudinally.

The outboard motor 10 includes an engine cover 12 for covering the top of the engine 11, an under cover 13 provided underneath the engine cover 12, an extension cover 14 provided underneath the under cover 13, and a gear case 15 provided underneath the extension cover 14.

A stern bracket 16 for attaching the outboard motor 10 to the hull is installed on the front of the under cover 13.

An air intake silencer 17 for leading outside air (fresh air) into an engine air intake port is disposed in front of the engine 11, and behind the air intake silencer 17 is disposed an electric component 18 for controlling the ignition of the engine and controlling the fuel injection device.

A crankshaft 21 shown by dashed lines has a flywheel 22 at the bottom. A drive shaft 23 linked to the bottom end of the crankshaft 21 passes through the under cover 13 and the extension cover 14 and links to a power transmission mechanism 24 inside the gear case 15.

The power transmission mechanism 24 transmits drive force from the drive shaft 23 to a horizontal driven shaft 25 oriented rearward from the front. The driven shaft 25 protrudes rearward out of the gear case 15, and a propeller 26 is secured to the rear end. By switching with a pair of dog clutches, the propeller can be switched between forward rotation and reverse rotation, resulting in forward and rearward propulsion force.

The engine cover 12 is attached to the under cover 13 by a hinge 27 on the rear side and a stopper 28 on the front side.

Figure 2:
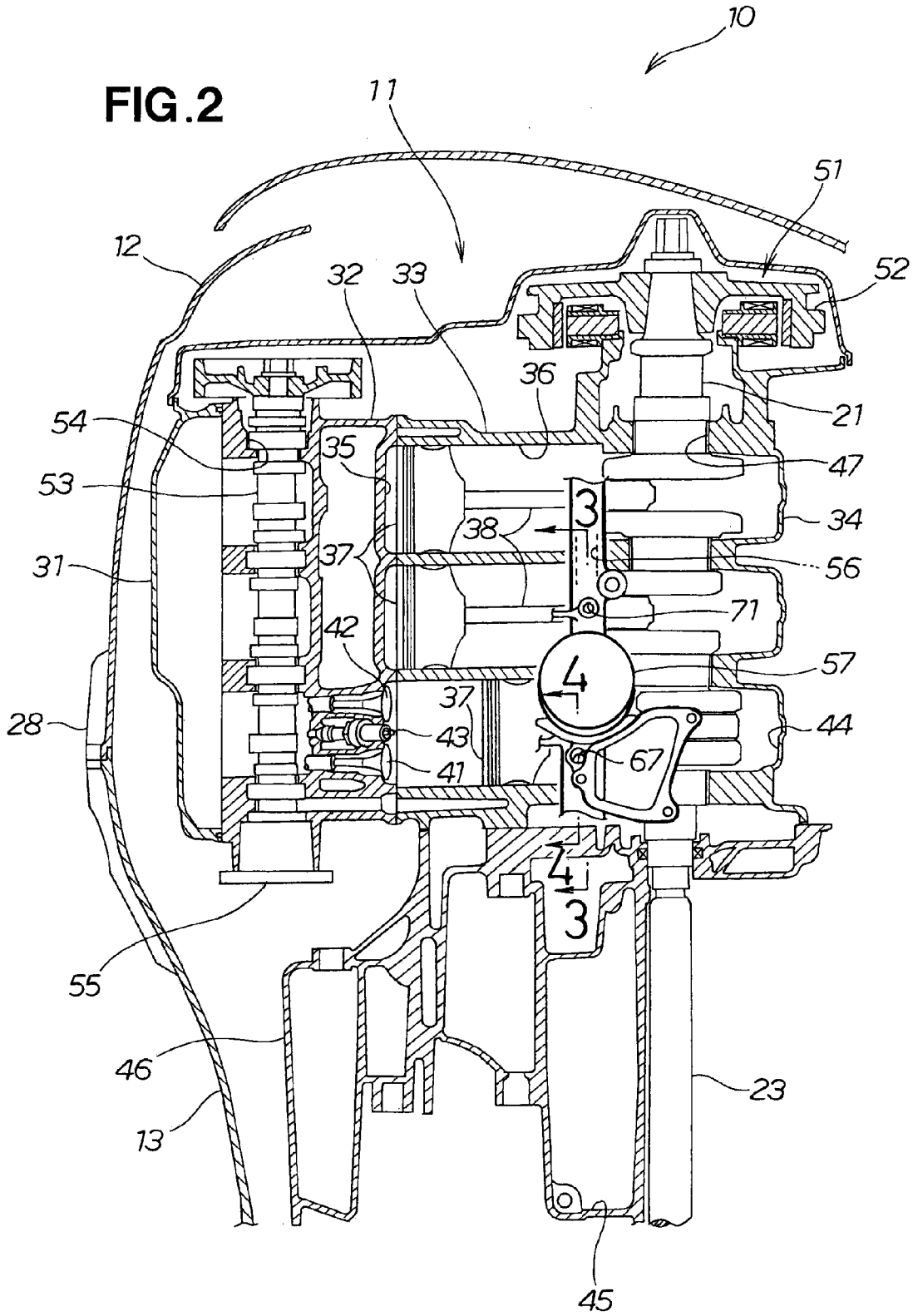
FIG. 2 is a cross-sectional view showing on an enlarged scale part of the outboard motor of FIG. 1.

The engine 11 includes a cylinder head cover 31 provided at the rear, a cylinder head 32 and cylinder block 33 provided in the middle, and a crankcase 34 provided in the front, as shown in FIG. 2.

The cylinder head 32 has a fuel chamber 35. The cylinder block 33 has a plurality of cylinders 36, and pistons 37 are slidably provided inside the cylinders 36. The crankshaft 21 is rotatably connected to the pistons 37 via connecting rods 38. The reference numeral 41 denotes an air intake valve, 42 denotes an exhaust valve, and 43 denotes an ignition plug.

An oil pan 45 is disposed at the bottom of a crank chamber 44 formed inside the crankcase 34, and the structure allows oil in the crank chamber 44 to flow down into the oil pan 45.

A mount case 46 is disposed at the bottom of the engine 11 and is used to support the engine 11. The oil pan 45 is provided in an oil case formed on the bottom surface of the mount case 46.

The crankshaft 21 is rotatably supported by a bearing 47. A power generator 51 and a recoil starter 52 are connected to the top end of the crankshaft 21.

A camshaft 53 is rotatably supported by a bearing 54 in the cylinder head 32. An oil pump 55 is connected to the bottom end of the camshaft 53 and is actuated by the rotational force of the camshaft 53.

A first oil passage (gallery) 56 is disposed in proximity to the cylinder block 33.

When the engine 11 is operating, the oil in the oil pan 45 is pumped up by the oil pump 55 and filtered by an oil filter 57, and the oil then flows through the vertically extending first oil passage 56. When the engine 11 stops, the oil pump 55 also stops and oil remains in the first oil passage 56.

The oil passage will be described referring back to FIG. 1.

The oil passage includes a first oil passage 56, a second oil passage 65, and a pumping oil passage 61 for pumping up oil from the oil pan. The oil filter 57 is provided between the first oil passage 56 and the pumping oil passage 61.

The oil pump 55 is provided in the path of the pumping oil passage 61. Oil in the oil pan 45 is pumped up from a strainer 58 held in the oil pan 45 and is pumped up by the oil pump 55 via the oil passage 61. The pumped oil is fed to and filtered by the oil filter 57 provided on the side surface of the cylinder block 33. The filtered oil is diverted and fed to the first oil passage 56 and the second oil passage 65 which diverges from the first oil passage.

The oil in the first oil passage 56 is supplied to the bearing 47 of the crankshaft 21, which is an engine component that requires the oil. The oil fed to the second oil passage 65 diverging from the first oil passage 56 is supplied via a spool valve 64 to the bearing 54 of the camshaft 53, which is another component of the engine.

Figure 3:
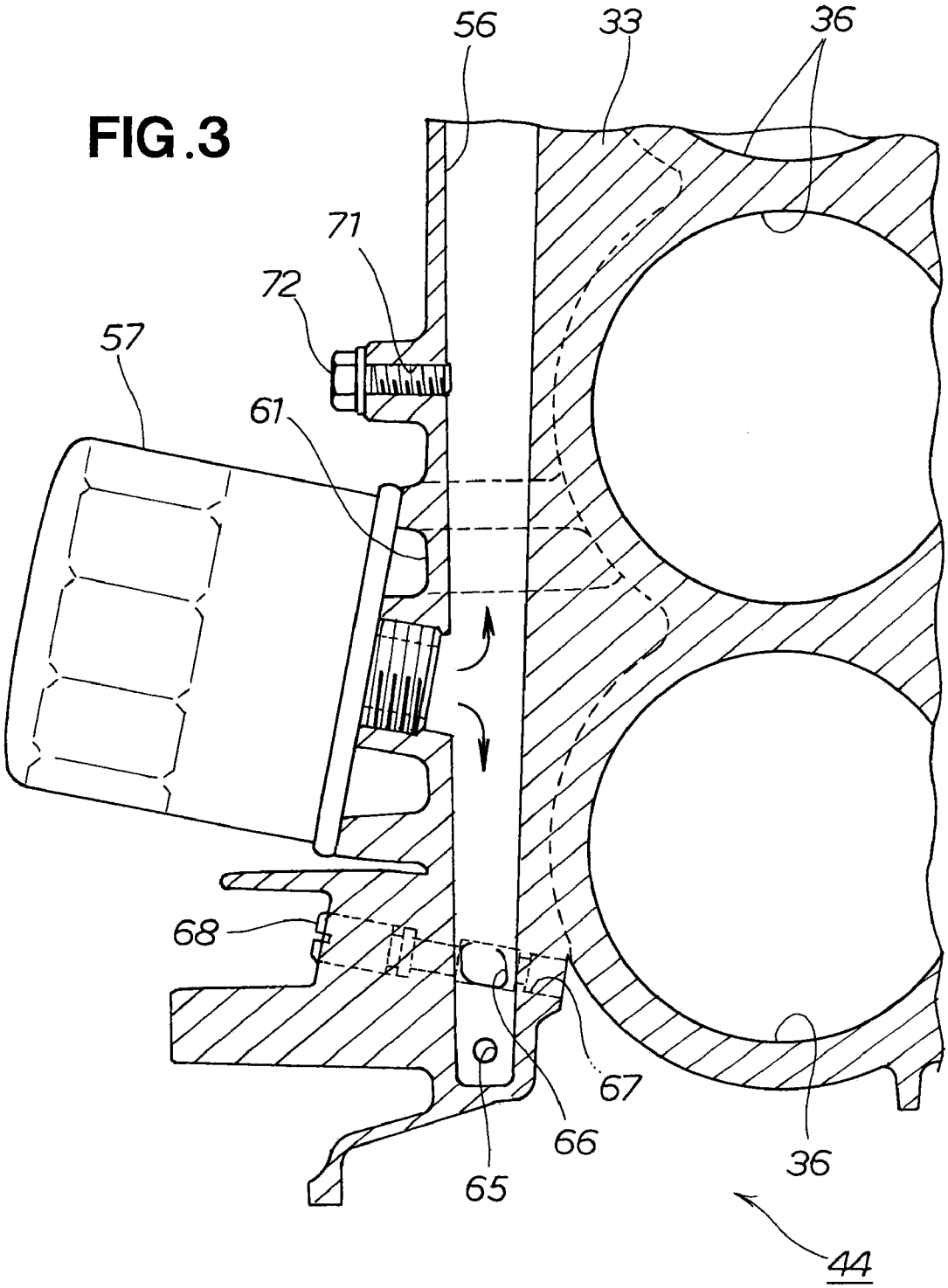
FIG. 3 is a cross-sectional view taken along line 3-3 of FIG. 2.

The oil sent out from the oil pump 55 (FIG. 2) flows into the oil filter 57 where it is filtered, as shown in FIG. 3. The filtered oil flows into the first oil passage 56, and the oil is diverted as shown by the arrows and supplied to the crankshaft 21 (FIG. 2) and the second oil passage 65.

A communication duct 67 for joining the main gallery 56 to the crank chamber 44 via a through-hole 66 is provided at a position lower than the oil filter 57. The communication duct 67 is closed by a drain valve 68 that can be opened and closed manually.

Furthermore, an air inlet duct 71 that allows air to enter from the exterior is provided to the first oil passage 56 at a position higher than the oil filter 57. The air inlet duct 71 is closed by an air vent bolt 72 that can be opened and closed manually.

According to FIG. 4, the drain valve 68 has a tapered part 73 at the distal end for closing off the communication duct 67, a threaded part 74 farther distally outward than the tapered part 73 for securing the drain valve 68 to the communication duct 67, and an O ring 75 at the rear for preventing oil leakage. The tapered part 73 can be brought in contact with a valve seat 76 to close the communication duct 67 by screwing in the threaded part 74.

Referring to FIG. 5, the drain valve 68 has a small-sectional-area part 77 located farther distally outward than the tapered part 73 and having less sectional surface area than the flow passage surface area of the communication duct 67 (FIG. 4). The small-sectional-area part 77 has a rectangular shape in the illustrated example, but is not limited to this shape and may have a columnar shape. Threads similar to the threaded part 74 are formed on the top and bottom edges of the small-sectional-area part 77. The drain valve 68 has at the rear end a groove 78 which cooperates with a fastening tool. As a result, the drain valve 68 can be opened and closed manually in a simple manner using a driver.

Next, the operation for removing the oil that has accumulated in the first oil passage 56 will be described based on FIGS. 6A through 6D.

Figure 6A:
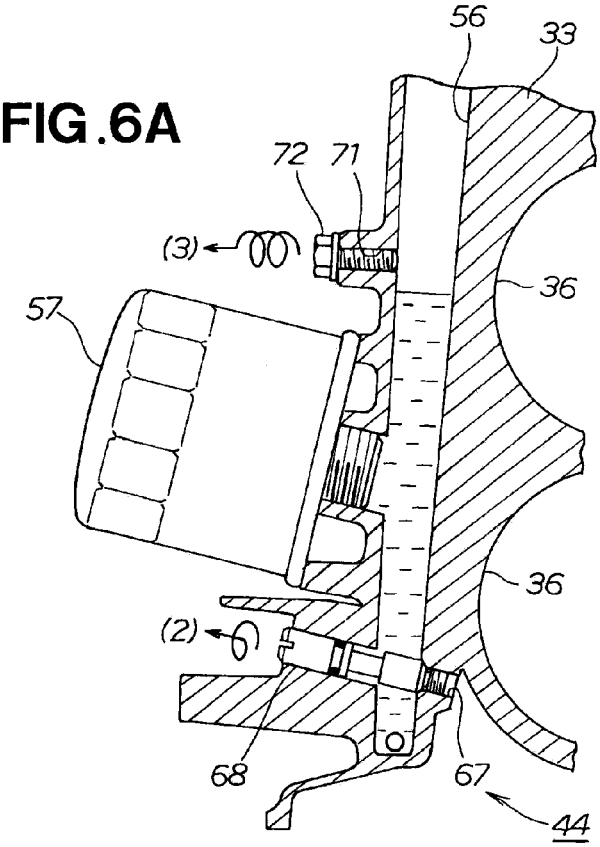
FIGS. 6A through 6D are views showing the working state up to letting out of the oil and replacing the oil filter.

The oil in the first oil passage 56 accumulates up to a position higher than the position of the oil filter 57, as shown in FIG. 6A. The drain valve 68 is rotated as shown by arrow (2), and the communication duct 67 opens. Next, the air vent bolt 72 is rotated as shown by arrow (3), and the air inlet duct 71 opens. Outside air flows into the first oil passage 56 through the opened air inlet duct 71.

Figure 6B:
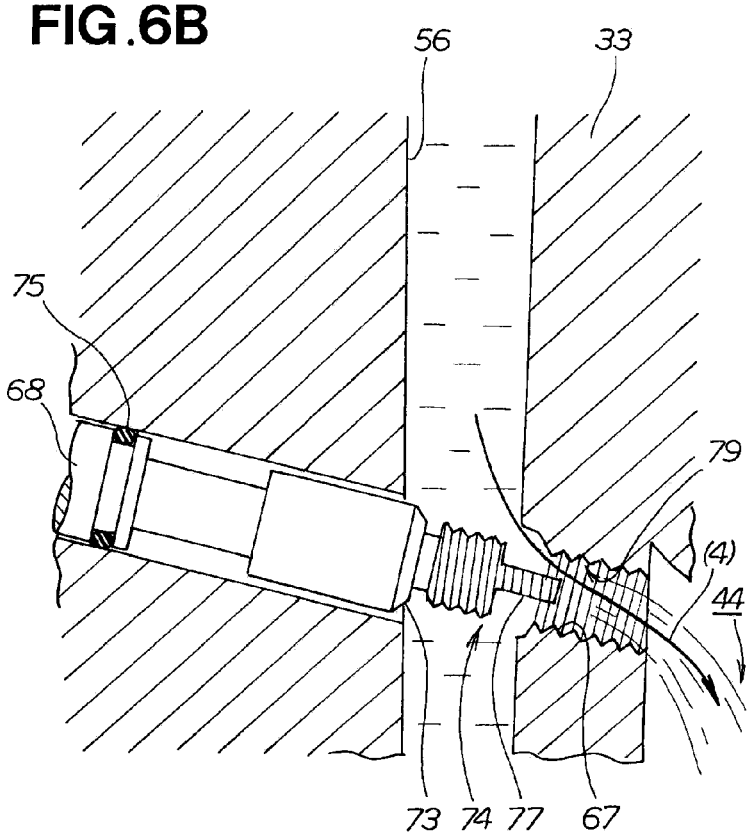

A gap is then formed between the drain valve 68 and the communication duct 67 as shown in FIG. 6B, and the oil in the first oil passage 56 flows out into the crank chamber 44 through the communication duct 67 as shown by arrow (4).

When the drain valve 68 is closed after the operation of replacing the oil filter 57 has ended, the threaded part formed on the small-sectional-area part 77 engages with a threaded part 79 of the communication duct 67, and the drain valve 68 can therefore be closed in a simple manner even through the distal end of the drain valve 68 is not visible. When the drain valve 68 is opened, the small-sectional-area part 77 may be removed from the communication duct 67.

Figure 6C:
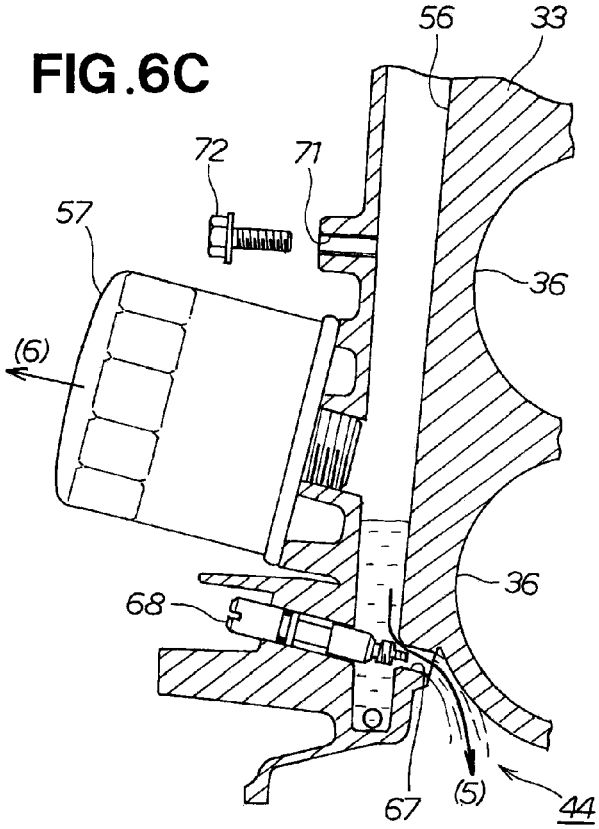

In FIG. 6C, the oil flows down into the crank chamber 44 as shown by arrow (5) until the oil in the first oil passage 56 is lower than the position of the oil filter 57. The oil filter 57 is then removed as shown by arrow (6). Oil does not leak out to the exterior at this time.

Figure 6D:
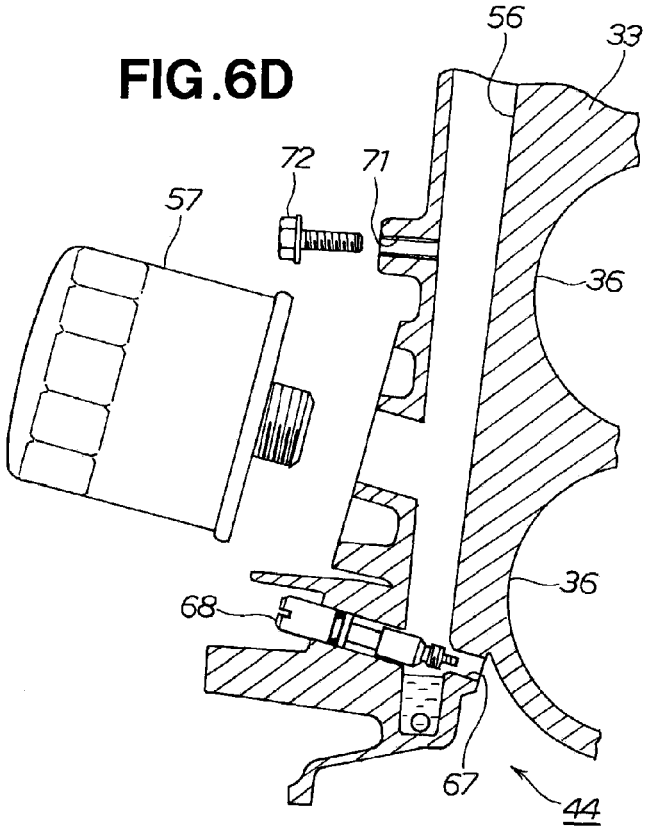
Figure 7:
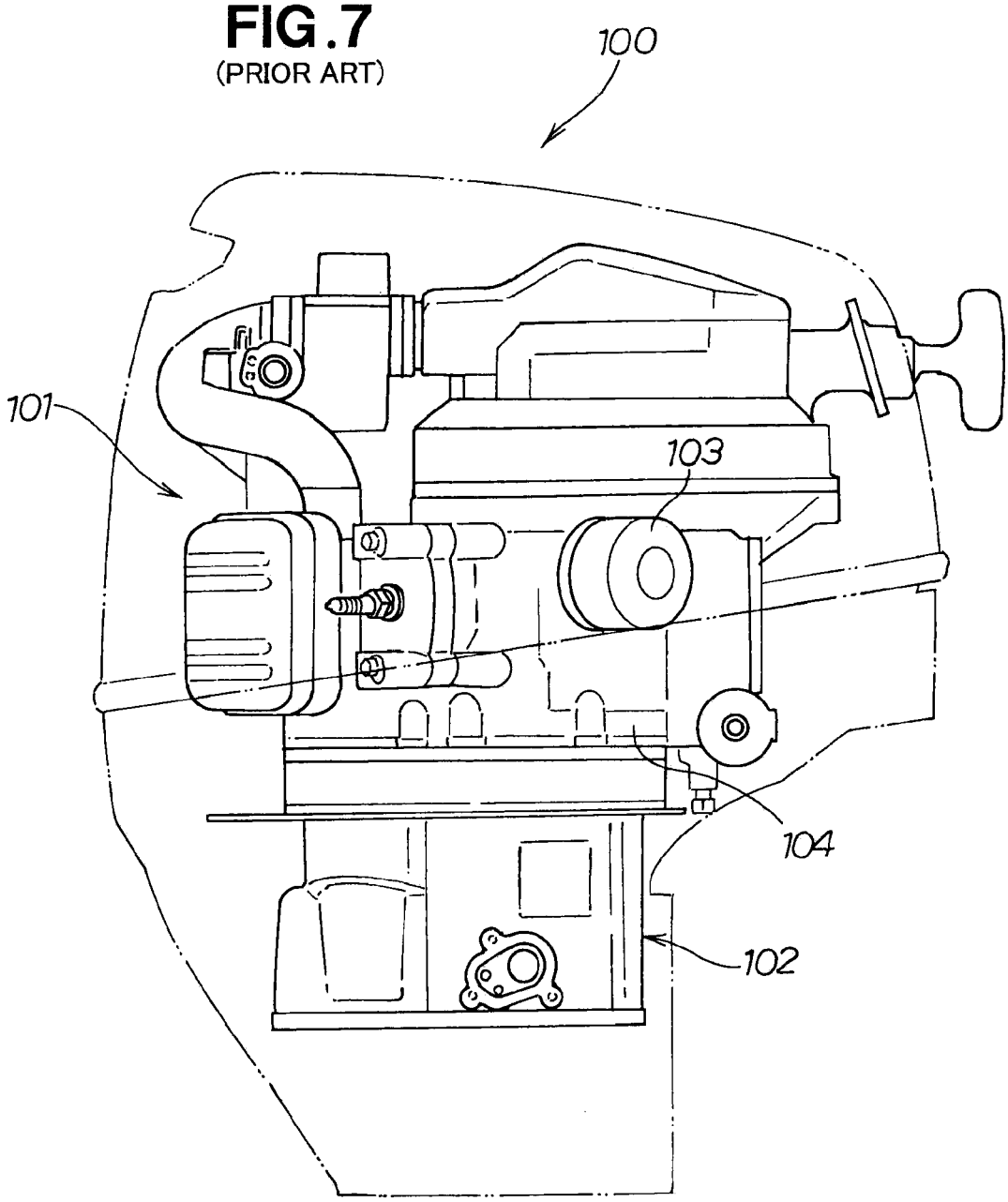
FIG.7 (PRIOR ART)
FIG. 7 is a schematic view showing the position where the oil filter is installed in a conventional example.
Figure 8:
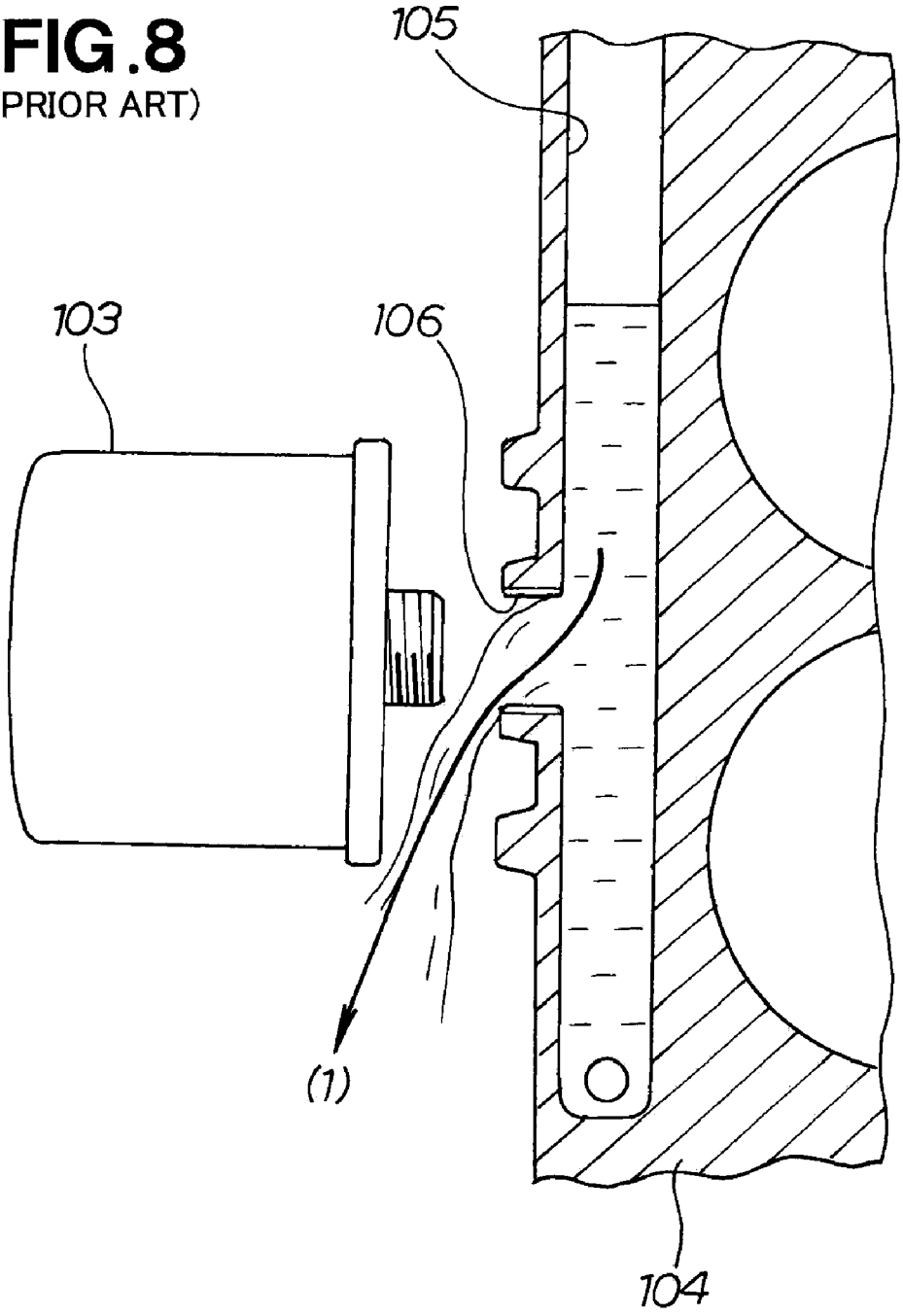
FIG.8 (PRIOR ART)
FIG. 8 is a view showing the manner in which oil flows out to the exterior of the outboard motor when the oil filter of FIG. 7 is replaced.

The drain valve 68 and the air vent bolt 72 are closed back up and a new oil filter 57 is attached as shown in FIG. 6D. Since oil does not flow out to the exterior and there is no need to add oil, it is possible to reduce the number of steps in the operation.

An example was presented in which the engine for an outboard motor according to the present invention was applied to a longitudinal engine in an embodiment, but the engine can also be applied to a so-called transverse engine, and the engine may be applied to other engines for outboard motors as long as the oil filter is installed in a midway position in the oil passage.

Obviously, various minor changes and modifications of the present invention are possible in light of the above teaching. It is therefore to be understood that within the scope of the appended claims the invention may be practiced otherwise than as specifically described.

What is claimed is:

1. An engine for an outboard motor, comprising:

an oil pan disposed underneath a crank chamber;

an oil pump for pumping up oil in the oil pan;

an oil filter for filtering the oil that has been pumped up; and a vertically extending oil passage for leading the filtered oil to parts required by the engine, wherein the oil passage has a communication duct disposed lower than the oil filter and communicating with the crank chamber, the communication duct has a valve seat and a threaded portion downstream of the seat, and a drain valve inserted into the communication duct, the drain valve being configured for selectively opening and fully closing the communication duct;

the oil passage has an air inlet duct positioned higher than the oil filter and designed to let air in from an exterior, the air inlet duct being closed by an air vent bolt capable of manual opening and closing;

the drain valve has a threaded, tapered part at a distal end thereof engaging the threaded portion of the communication duct for bringing the valve face into engagement with the valve seat closing off the communication duct; and the drain valve has a small-sectional-area part located farther distally outward than the tapered part and having less sectional surface area than a flow passage surface area of the communication duct, the small-sectional-area part being inserted through the communication duct.

* * * * *